United States Patent [19]

Schuh

[11] Patent Number: 4,691,495

[45] Date of Patent: Sep. 8, 1987

[54] PRODUCT RETARD DEVICE FOR DROP-LOADING PACKAGING MACHINE

[75] Inventor: Rudolf Schuh, Schweich, Fed. Rep. of Germany

[73] Assignee: The Mead Corporation, Dayton, Ohio

[21] Appl. No.: 886,713

[22] Filed: Jul. 18, 1986

[30] Foreign Application Priority Data

Jul. 20, 1985 [GB] United Kingdom ..... 8518360

[51] Int. Cl.[4] ..... B65B 21/02; B65B 5/06

[52] U.S. Cl. ..... 53/48; 53/248

[58] Field of Search ..... 53/48, 248, 543, 535, 53/536, 534

[56] References Cited

U.S. PATENT DOCUMENTS 4,389,832 6/1983 Calvert ..... 53/48

4,570,413 2/1986 Raudat ..... 53/248

FOREIGN PATENT DOCUMENTS 957704 5/1964 United Kingdom ..... 53/248

*Primary Examiner*—Horace M. Culver

*Attorney, Agent, or Firm*—Erwin Doerr

[57] ABSTRACT

In a packaging machine in which bottles (P) or the like are drop-loaded into open topped article carriers (C), a device for interrupting the fall of bottles into a carrier. The device comprises a pivotal arm (32) which includes resiliently mounted support blocks (42, 44) adapted to displace a base panel (b) of a carrier upwardly at a drop-loading station of the machine and provide a temporary platform onto which the dead load of a bottle is transmitted during interruption of drop-loading while the base panel remains displaced. The pivotal arm is cam-actuated so that it pivots in one direction to cause the carton base panel displacement and thereafter in the opposite direction to allow completion of loading by withdrawal of the support blocks so that the dead load of the bottle is transferred from the support blocks to the carrier base.

5 Claims, 9 Drawing Figures

PRODUCT RETARD DEVICE FOR DROP-LOADING PACKAGING MACHINE

This invention relates to a device for interrupting the fall of bottles or other articles into an open-topped carton, particularly a carton which is a basket-style carrier.

In a drop-loading system bottles or other primary containers are conveyed to a drop-loading station so that they arrive in synchronism with cartons to be loaded. The cartons are fed continuously along a feed path below the bottle feed line and drop-loading takes place as the cartons move through the drop-loading station.

The invention provides in a packaging machine in which articles are drop-loaded into open-topped article carriers a device for interrupting the fall of articles into a carrier, said device being characterised by support means to displace a base panel of a carrier upwardly at a drop-loading station of the machine and provide a temporary platform onto which the dead load of an article is transmitted during interruption of said drop-loading while said base panel is displaced and means to actuate said device to cause said displacement and thereafter to allow completion of loading by withdrawal of said support means so that the dead load of said article is transferred from said support means to the carrier base.

It is preferred that the support means is adapted to flex upon initial impact of said article so that the impact force is minimised. The carriers preferably are conveyed to said drop-loading station along a feed platform adapted to allow passage of said support means therethrough at the drop-loading station, the dead load of said article being transferred to the feed platform on which the carrier base rests, during withdrawal of said support means.

The support means may be actuated to provide the temporary platform and execute the load transfer cyclically for successive articles loaded into the carrier as the carrier is conveyed through the drop-loading station.

In some constructions, the support means may be pivotal from an inoperative withdrawn position to an operative position in which said temporary platform is provided. In constructions where this feature is adapted the support means is provided by a pivotal arm disposed below the path of movement of the carrier through the drop-loading station, the arm including a cam follower engageable with an endless series of cam plates moveable below the pivotal arm, the cam follower and the cam plates providing the actuating means for the support means. Preferably the cam plates include means for engagement with the carriers to convey the carriers to the drop-loading station. Each cam plate may comprise a leading ramp to raise the pivotal arm into a position where the support means provides the temporary platform, a dwell platform to maintain the support means in a position to interrupt the drop-loading and a trailing ramp to cause the withdrawal of the support means and effect the load transfer. Preferably the support means comprises a pair of spaced blocks carried at one end of the pivotal arm remote from its pivotal mounting, said one end of the pivotal arm being provided by a resilient element to allow that end of the arm to flex upon impact of an article on the blocks.

An embodiment of the invention will now be described, by way of example, with reference to the accompanying drawings in which.

Figure 1:
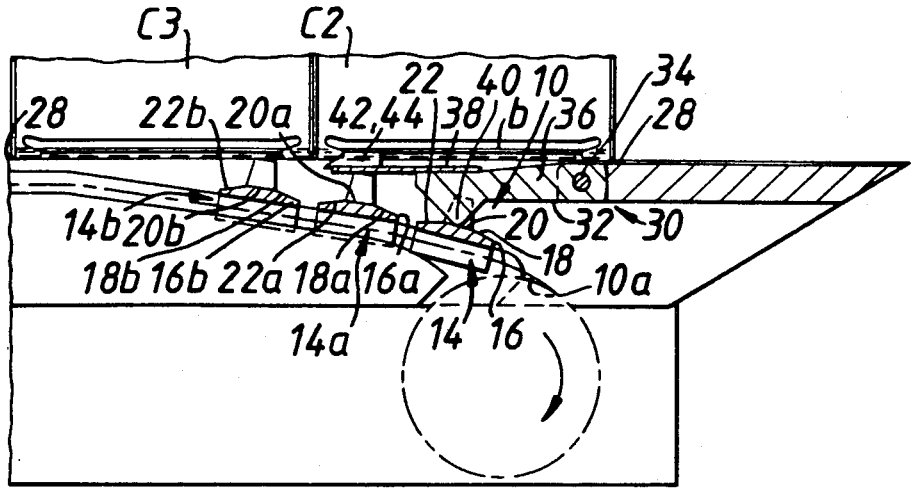
FIG. 1 is a side view of a mechanism according to the invention shown in partial cross-section taken on the line 2—2 in FIG. 2.
Figure 2:
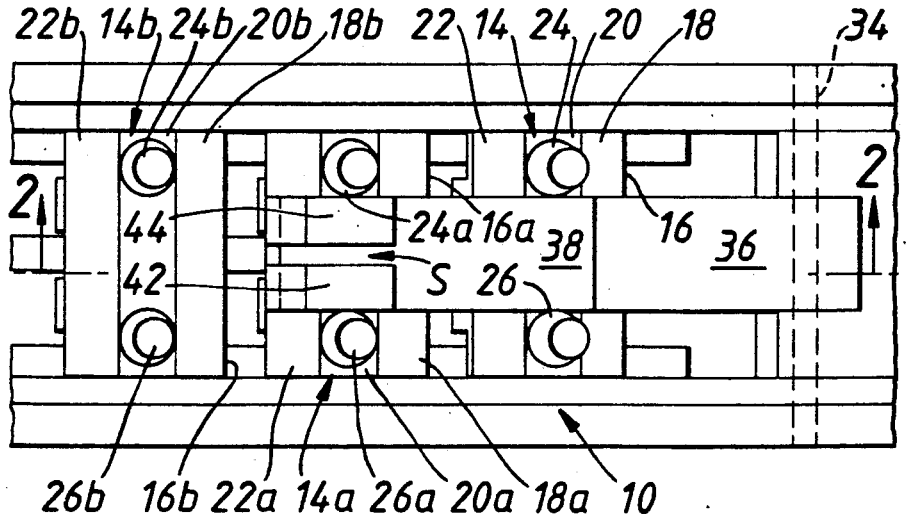
FIG. 2 is a plan view of the mechanism.
Figure 3:
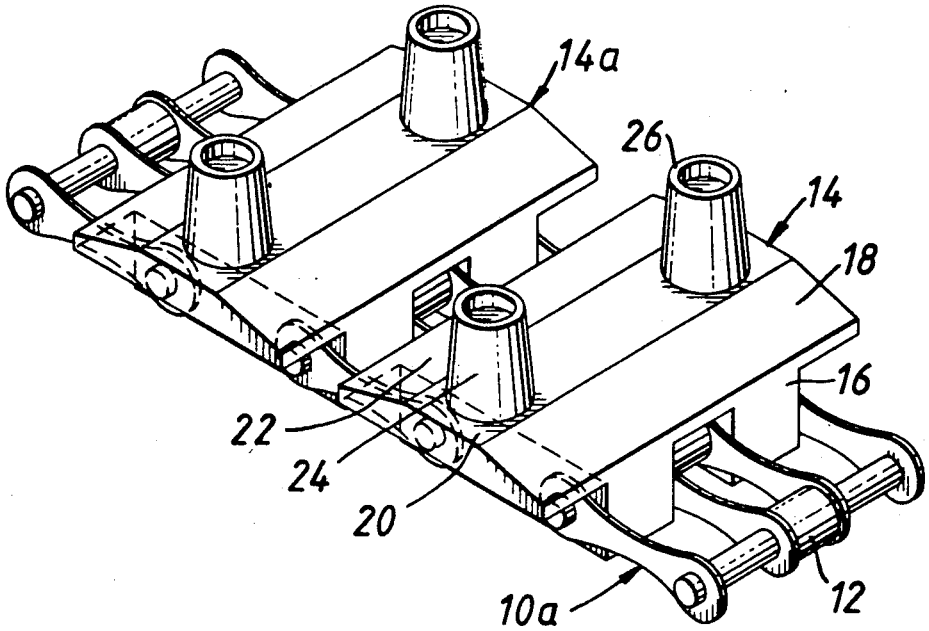
FIG. 3 is a perspective view of the carton conveying elements.

Referring first to FIGS. 1 to 3 of the drawings, a carton conveyor 10 comprises an endless chain 10*a* in which the chain link sets 12 pivotally interconnect a series of similar spaced carton engaging elements 14, 14*a*, 14*b* etc. Each carton engaging element e.g. element 14 comprises a plate 16 having a continuous top face formed to provide a leading ramp 18, a dwell platform 20 and a trailing ramp 22. The plate 16 is pivotally connected to the chain link sets beneath its top face. A pair of carton engaging projections 24 and 26 of frusto-conical form is upstanding from the dwell platform 20 each at spaced locations adjacent the side edges of the plate. Like parts of carton engaging elements 14*a*, 14*b* are designated like reference numerals with the addition of suffixes 'a' and 'b' respectively.

The carton conveyor is disposed below a carton feed platform 28 which includes a drop-loading station in the vicinity occupied by carton $C^2$ shown in the drawings. Both the carton feed and movement of the carton engaging elements is from left to right as viewed in the drawings. FIGS. 1, 2 and FIGS. 4–9 show the outfeed end of the arrangement in terms of carton flow through a machine furnished with a mechanism according to the invention. As cartons arrive on the carton feed platform they are engaged by the projections of the carton engaging elements at the infeed end of the machine (not shown) and are thereby conveyed along the carton feed path one after the other to the drop-loading station. An article, e.g. bottle, feed line is provided above the carton feed path and it is the purpose of the projections of the carton engaging elements to ensure that the arrival of successive cartons and bottles at the drop-loading station is synchronised. To this end the projections engage suitably positioned apertures provided in the carton bases and disengage therefrom immediately prior to the drop-loading station. It will be seen for example that whereas carton engaging element 14*d* is in conveying engagement with carton $C^3$, element 14*c* is about to disengage from that carton as the series of elements is constrained to move along a downwardly inclined path at the outfeed end of the machine.

Referring now more particularly to FIGS. 1 and 2, an article retarding device 30 is disposed at the outfeed end of the machine intermediate the carton conveyor 10 and the carton feed platform 28. Device 30 comprises a pivotal arm 32 which is hinged at one of its ends by pivot 34 to a fixed part of the machine below the carton feed platform and has an opposite free end positioned directly below the drop-loading station. The pivotal arm comprises a relatively rigid first portion 36 which may be formed from a plastics material and a resilient second portion 38 extending from portion 36 and which preferably is formed from spring steel. The first portion includes an integral downwardly directed follower projection 40 which is positioned to ride on the top faces of successive plates 16 of the carton engaging elements. The arm has a tendency to adopt the position shown in FIG. 4 i.e. where its free end is at its lowermost position by virtue of the arm's own weight. The second portion of the arm carries on its upper surface a pair of spaced retard blocks 42 and 44 (FIG. 2) adapted to engage the base of a carton present at the drop-loading station when the pivotal arm is caused to pivot so that its free end is at an uppermost position.

Figure 4:
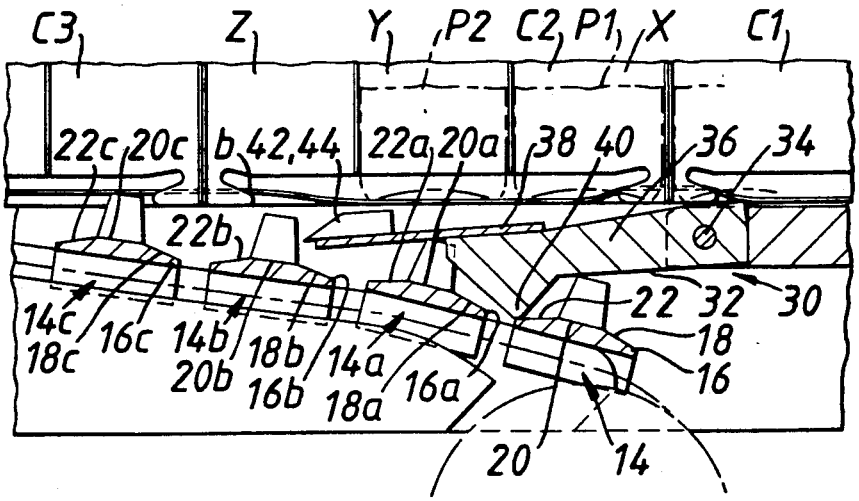
FIGS. 4–9 are side views of the mechanism showing sequentially the cycle of operation thereof.
Figure 5:
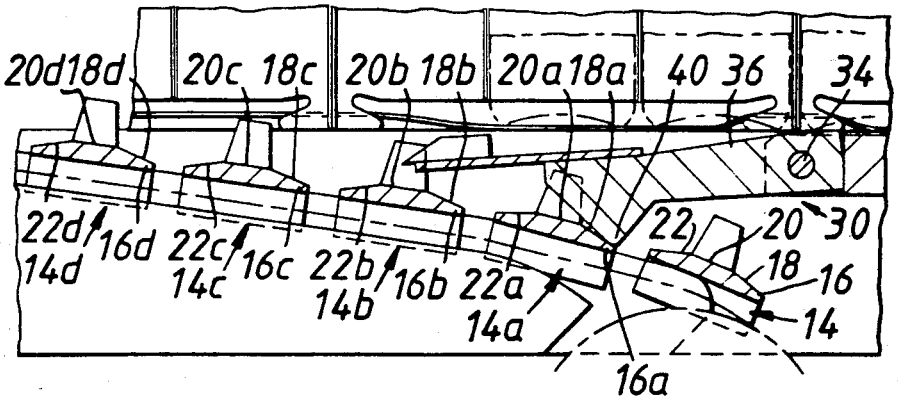

Referring to FIGS. 4 to 9, in FIG. 4 the follower projection 40 is about to leave the trailing ramp 22 of plate 16 at which location the retard blocks are at their lowermost position clear of the base panel 'b' of carton $C^2$. Carton $C^2$ has been loaded with front bottle pair P in compartments 'X' intermediate bottle pair $P^2$ in compartments 'Y' and, to complete loading, requires a rear bottle pair to be received in compartments 'Z'. In FIG. 5, carton $C^2$ has moved forwardly (by pressure exerted on its trailing end wall by the next succeeding carton $C^3$) so that compartments 'Z' are about to enter the drop-loading position. The follower projection 40 is in abutment with the front edge of leading ramp 18*a* of plate 16*a*.

Figure 6:
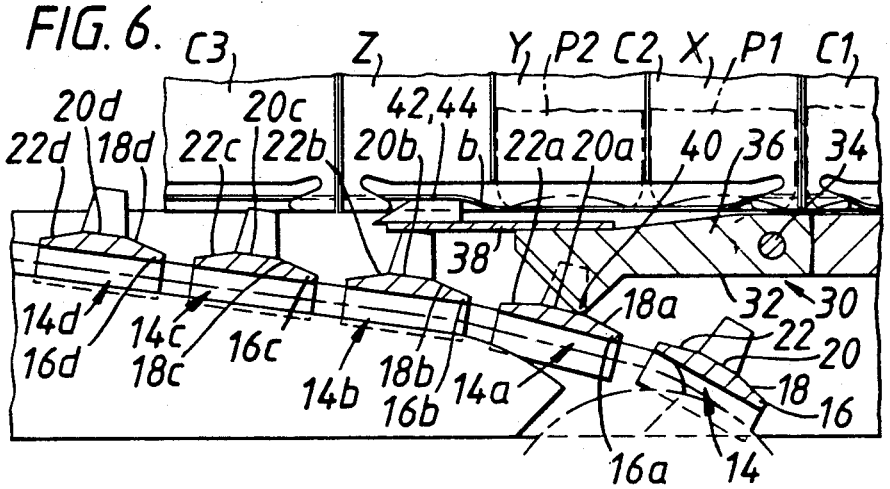

In FIG. 6, carton $C^2$ has further moved forwardly so that compartments 'Z' are a the drop-loading position. The follower projection 40 has ridden up the leading ramp 18*a* and is positioned at the front edge of dwell platform 20*a*. Thus, the pivotal arm 32 has pivoted upwardly so that the retard blocks have engaged and upwardly displaced that part of the carton base panel 'b' which forms the bottom of compartments 'Z'. The retard blocks are then in their uppermost position in which the displaced portion of the carton base panel is raised above the level of the remaining part of the base panel.

Figure 7:
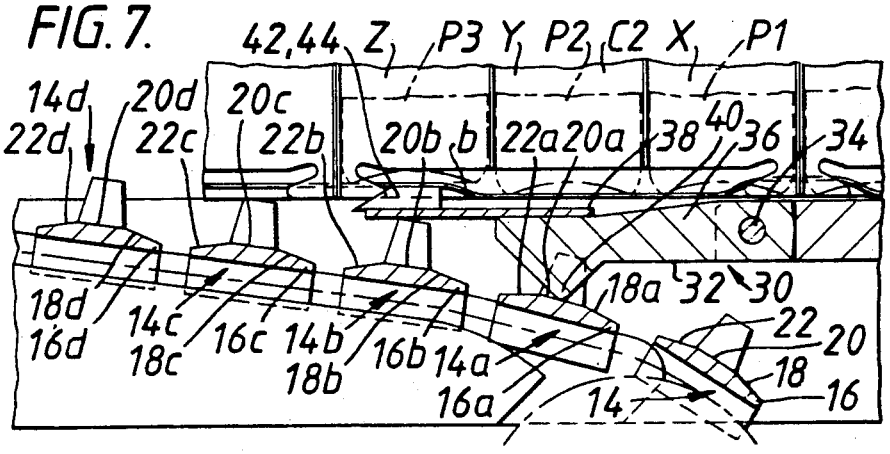

In FIG. 7, bottle pair $P^3$ has been drop-loaded into compartments 'Z' while the pivotal arm has remained stationary during relative movement between the follower projection 40 and dwell platform 20*a*. Thus, the bottle pair $P^3$ have dropped onto and are temporarily supported by respective ones of the retard blocks. Owing to the resilient nature of the second portion 38 of the pivotal arm 32, at the moment of impact of the bottle bases, portion 38 flexes downwardly to cushion the fall of the bottles whereby the force of impact is minimised and transmission of noise is reduced.

Figure 8:
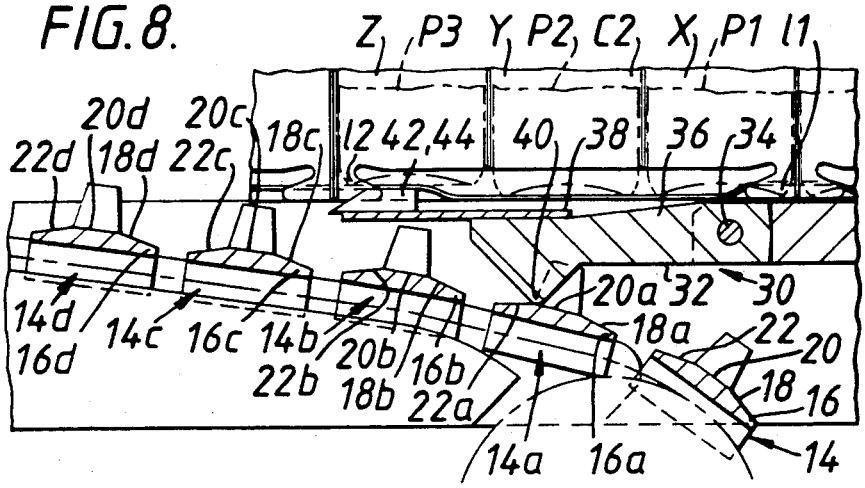

At the position shown in FIG. 8, the follower projection is poised at the front edge of trailing ramp 22*a* so that the retard blocks still support bottles $P^3$ in a raised attitude relative to the previously loaded bottle pairs P' and $P^2$. However, carton $C^2$ has moved further forwardly and lower portions of base panel retaining lock $1^2$ (provided at the lower extremity of a central carton partition) is able to pass unobstructed through the space 'S' between the retard blocks 42 and 44. This arrangement also ensures that the integrity of the base panel end retaining locks is not disrupted by the presence of the retard blocks.

Figure 9:
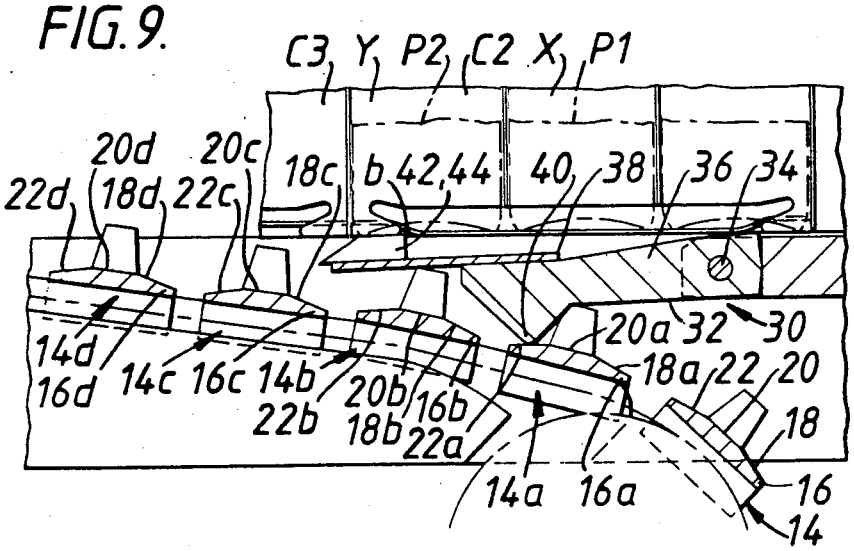

At the position illustrated by FIG. 9, the carton has further advanced and the follower projection 40 has moved down the trailing ramp 22*a* to a location at which the retard blocks have moved out of engagement with the carton base panel. In so doing, the bottles '$P^3$' have gradually been lowered into their fully loaded position in compartments 'Z' together with the base panel 'b' so that the base panel 'b' and all the bottles are then supported by the carton feed platform 28.

It will be appreciated that the carton feed platform is constructed to include suitable slots to allow for entry therethrough of the conveying projections and retard blocks above the general plane of the platform. The retard blocks then remain in their lowermost position until the pivotal arm is next raised for a period of sufficient duration as to enable the blocks to clear beneath the base retaining lock at the leading edge of the next succeeding carton $C^3$. Thereafter the above cycle of operations is repeated.

I claim:

1. In a machine for conveying empty open-top article carriers along a feed platform to a loading station and drop-loading articles such as bottles or the like into the article carriers at said loading station, a device for intercepting the fall of the articles after they have entered the article carriers, said device comprising support means arranged at the loading station to temporarily displace the base panel of the article carriers upwardly and provide an elevated platform to which the dead load of the articles is transmitted when the articles are dropped into the article carriers, actuating means for causing said support means to be displaced upwardly and thereafter withdrawn whereby the dead load of said articles is transferred from said support means to the base panel of said article carriers, said support means comprising a pivotal arm disposed below the path of movement of said article carriers, and said feed platform being constructed so as to permit said pivotal arm to engage the base panel of said article carriers, characterized in that said actuating means includes an endless series of cam plates arranged to move below said pivotal arm and a cam follower associated with said pivotal arm so as to cooperate with said cam plates.

2. A device according to claim 1, further characterised in that said support means is acutated to provide said temporary elevated platform and execute said load transfer cyclically for successive articles loaded into said carrier as the carrier is conveyed through said drop-loading station.

3. A device according to claim 1 further characterised in that said cam plates include means for engagement with said article carriers to convey said carriers to said drop-loading station.

4. A device according to claim 1, further characterised in that each cam plate comprises a leading ramp to raise said pivotal arm into a position where said support means provides the temporary platform, a dwell platform to maintain said support means in a position to intercept said articles and a trailing ramp to cause said withdrawal of the support means and effect said load transfer.

5. A device according to claim 1, further characterised in that said support means comprises a pair of spaced blocks carried at one end of the pivotal arm remote from its pivotal mounting, said end of the pivotal arm being provided by a resilient element to allow that end of the arm to flex upon impact of an article on said blocks.

* * * * *